United States Patent [19]

Walker et al.

[11] 3,978,832

[45] Sept. 7, 1976

[54] SERVO MECHANISM

[75] Inventors: Brooks Walker; Fred V. Hall, both of San Francisco, Calif.

[73] Assignee: Brooks Walker, San Francisco, Calif.

[22] Filed: Feb. 15, 1974

[21] Appl. No.: 442,835

Related U.S. Application Data

[63] Continuation of Ser. No. 141,967, May 10, 1971, abandoned, which is a continuation of Ser. No. 571,563, Aug. 10, 1966, abandoned.

[52] U.S. Cl. ..... 123/117 A; 123/117 R; 123/146.5 A

[51] Int. Cl.[2] ..... F02P 5/02

[58] Field of Search ..... 123/117 A, 117 R, 146.5 A

[56] References Cited

UNITED STATES PATENTS

| | | | |
|---|---|---|---|
| 2,650,581 | 9/1953 | Short et al. | 123/117 A |
| 3,046,962 | 7/1962 | Norris | 123/117 A |
| 3,081,793 | 3/1963 | Flatt et al. | 123/117 A |
| 3,326,197 | 6/1967 | Elkins | 123/117 A |
| 3,353,524 | 11/1967 | Sarto | 123/117 A |
| 3,476,094 | 11/1969 | Rucins et al. | 123/117 A |
| 3,810,451 | 5/1974 | Fales | 123/117 A |
| 3,824,972 | 7/1974 | Sattler | 123/117 A |

*Primary Examiner*—Charles J. Myhre
*Assistant Examiner*—Tony M. Argenbright
*Attorney, Agent, or Firm*—Jay M. Cantor

[57] ABSTRACT

A device for temporarily changing the ignition setting of an internal combustion engine in response to a sudden change of the suction in the intake manifold. A suction operated motor is connected to the ignition timing mechanism to control the suction operated timing of the ignition in response to intake manifold suction changes. The action of the motor is controlled for a selected time interval to reduce the suction operated spark advance for a substantial portion of a normal level road acceleration in city driving as sensed by the change in intake manifold suction.

10 Claims, 1 Drawing Figure

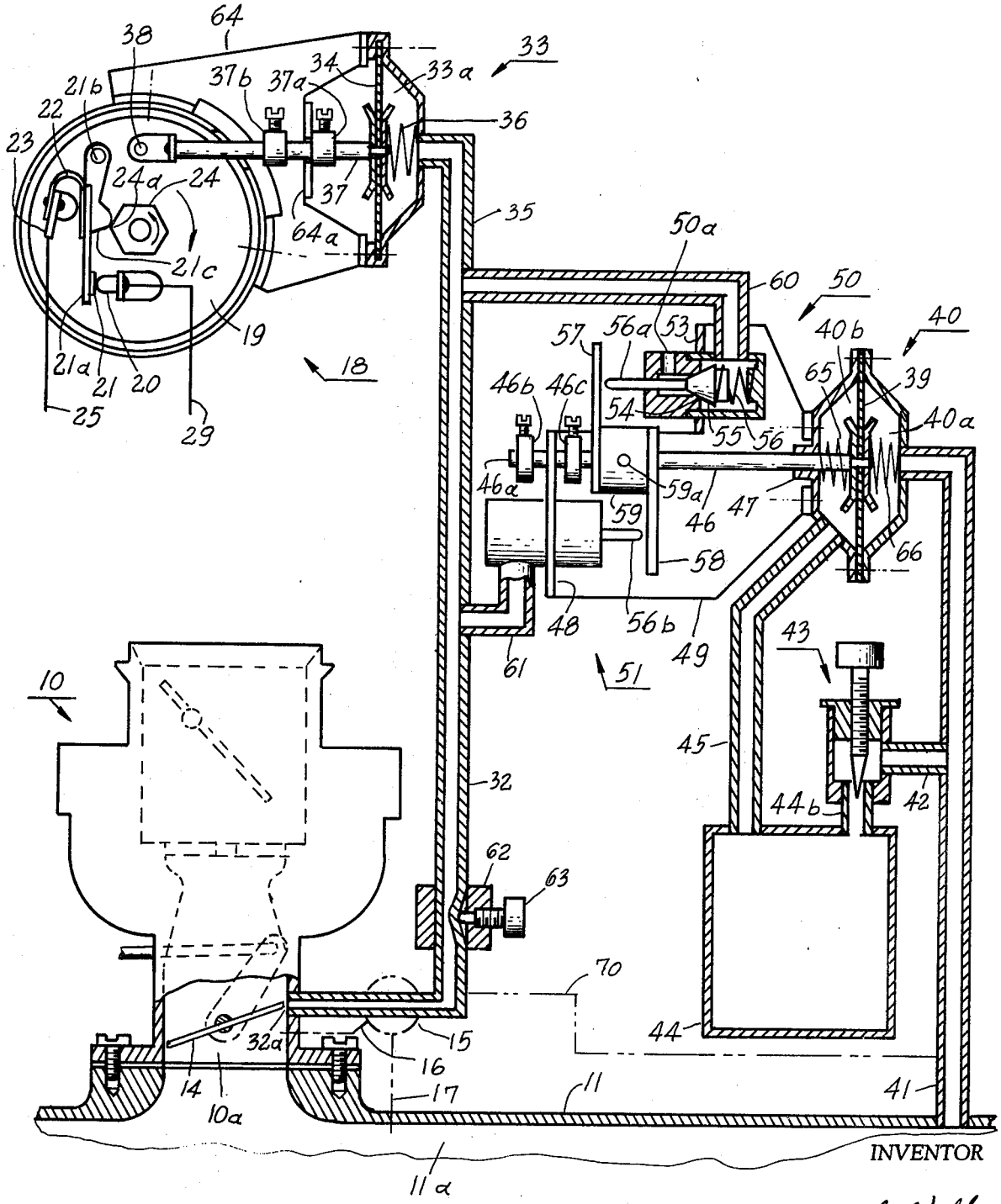
INVENTOR
Brooks Walker
Fred V. Hall

SERVO MECHANISM

This is a continuation of Ser. No. 141,967, filed May 10, 1971 now abandoned, which was a continuation of Ser. No. 571,563, filed Aug. 10, 1966, now abandoned for SERVO MECHANISM.

This invention relates to ignition systems for internal combustion engines and in particular to means whereby a given ignition setting which has been achieved by conventional arrangements may be changed temporarily from the said conventional setting in response to a change in any mode operation, for example acceleration.

It is proposed that such temporary change of the spark may be achieved by means whereby changes in the manifold pressure may be registered and made operative to effect temporarily a partial or total cancellation of the advance setting achieved by other, conventional control means. The proposed system may also be used in the reverse manner, i.e. a partial or total cancellation of conventional devices whose action is to retard spark timing.

Such temporary spark timing change (retardation) is desirable as a means to reduce the incidence of smog producing constituents in the exhaust during all or part of an acceleration operation. Its significance appears from the following table which is derived in substance from a publication by the State of California in connection with its efforts to reduce smog.

| Phase of operation | Duration of phase of operation | Weight factor (Emission evaluation) | Acceleration weight factor |
|---|---|---|---|
| Idling | | 4.2% | |
| 0–25 mph (accel.) | 8.8 sec. | 24.4% | 24.4 |
| 30 mph cruise | | 11.8% | |
| 30–15 (decel) | 10.7 sec. | 6.2% | |
| 15 mph cruise | | | |
| 15–30 mph (accel.) | 12.5 sec. | 45.5% | 45.5 |
| 50–20 mph (decel) | 25 sec. | 2.9% | |
| | | | 69.9 |
| Limit HC | 275 Parts per million CO 1.6% | | |

The table shows that the acceleration phases, which involve changes in the mode of operation, are the most heavily weighted. It is further significant that such changes take on the average approximately 10.5 seconds to complete, so that retardation between 8.8 and 12.5 seconds may be highly desirable to reduce emissions. After such temporary retard it is highly desirable to restore the advance for fuel economy and performance. It is further significant that the operativeness of smog control devices is greatly affected by varying operating conditions and it has been well established that retarding the spark can reduce emissions. The arrangement according to the invention fills therefore an urgent need because it affords advantages in coping with the smog problem especially during such phases of changing modes of operation, which result in high emissions such as emissions at the start of or during test accelerations or continued hill climbing.

It is one object of the invention to provide a new method for the control of the ignition.

It is another object of the invention to provide an ignition control scheme which is operative in addition to existing devices and without unduly interfering with their operations.

It is a further object of the invention to provide a method for the control of the ignition which will be an improvement over the conventional spark control for the purpose of reducing exhaust emissions.

It is a fourth object of the invention to provide means for the temporary retarding of the ignition following an acceleration for a limited period following the commencement of such operations, e.g. 5 to 15 seconds.

It is a fifth object of the invention to utilise a necessary incident of the change in the mode operation, viz. a change in the manifold pressure, to actuate the device according to the invention.

It is a sixth object of the invention to provide an arrangement which can be used in most conventional designs of internal combustion engines and is especially adapted for use on existing engines.

It is a seventh object of the invention to provide means to reduce or eliminate the vacuum advance setting then in effect by virtue of the operation of other ignition control arrangements for a predetermined period following a change in the mode of operation.

It is an eighth object of the invention to provide a mechanism which will be operative when changes in the operation result in moderate changes in the intake manifold pressures to effect an acceleration of a vehicle, such mechanism cutting out or reducing the normal vacuum advance for a short time following on acceleration and then returning the spark advance to normal for continued acceleration, hill climbing or curves.

It is a ninth object to use a reservoir and limited flow of suction to the reservoir and a device operating on the differential pressures between the l, m, and the reservoir to control the temporary spark retard following the start of an acceleration.

The invention is described hereinafter with reference to a typical embodiment and illustrated in a drawing which shows various components of an internal combustion engine, partly in section, in combination with diagrammatic representations. For the sake of brevity, conventional routines are assumed as known, for example that two parts may be fastened together in various ways, such as soldering, riveting or by means of screws. Generally, parts shown as contiguous are intended to make an airtight joint. No reference is generally made to particular materials unless the material is used in particular reference to a unique characteristic. Whenever the term "suction" is used, it is intended to mean air being drawn into a space of lower pressure.

The drawing shows on its left half certain essential elements of a conventional ignition advance system. Suction prevailing in the interior 11*a* of an intake manifold 11 is communicated to the throat 10*a* of a carburetor 10 and modified as it passes a throttle valve 14. The suction in the carburetor throat 10*a* or near butterfly 14 is communicated through a port 32*a* (sometimes called carburetor spark advance port), duct 32 to the interior 33*a* of an advance motor 33, causing a diaphragm 34 to yield to the right against spring 36 and pull, by means of an attached rod 37 and connection 38, a breaker plate 19 into clockwise advancement. A breaker arm 21*a* pivoted at 21*b* on the breaker plate 19 and thus moving with the breaker plate 19, is thereby moved to a point at which it will be deflected earlier than otherwise by one of the lobes, e.g. a lobe 24*a*, of a breaker cam 24 which rotates counterclockwise under the control of the engine and a spark advance governor (not shown) and makes and breaks a contact between a contact element 21 on breaker arm 21*a* and contact element 20 on the breaker plate 19. Contact elements 21 and 20 are located within a circuit which forms part of an involved arrangement including aside from the partially shown leads 25 and 29 spring 22 and terminal 23 and various other well known elements, e.g. an induction coil, a distributor and, ultimately, a spark plug in a conventional manner so that some parts are not shown.

As a matter of convenience, the movement of the diaphragm 34 may be limited by two steps 37*a* and 37*b* and an upright element 64*a* of a bracket 64 between them. Moreover, a spring 36 which may serve the function of centralising the diagram against stop 37*a* may also serve as a means of defining a lower limit which the suction, at port 32*a*, must exceed before the diaphragm 34 will respond and a vacuum controlled spark advance will start.

Thus, the conventional mechanism may be set to respond by advancing the ignition when the suction at port 32*a* may be above 8–10 inches hg as during cruises from 30 to 70 mph. When the throttle is "wide open" and the pressure in the intake manifold and port 32*a* drops to 1 – 3 hg there will be no vacuum advance, but there will be the normal governor advance. In at least one advanced engine design special means are provided to insure that the ignition advance will be maintained on high speed decelerations even though the throttle valve 14 is in the idle position (so that the port 32*a* is at essentially atmospheric pressures). Such means comprise a sensing valve 15 which is actuated through a duct 16 and admits suction from below the throttle valve 14 through a special duct 17 or duct 16 to the duct 32, while communication with the port 32*a* is sealed off at the same time. An arrangement of this type is described in greater detail on Page 3 in a pamphlet entitled "The Chrysler Clear Air Package" published by the Chrysler Corporation in November, 1964, and revised in January, 1966, per copy attached.

The arrangement according to the invention is operative to reduce an advancement setting resulting from the vacuum advance mechanism just described by bleeding the suction in duct 35 for a short period of time following an acceleration by mechanism to be described.

A sensing device, generally indicated at 40, is provided in the form of an airtight vessel divided by a movable wall or diaphragm 39, a right compartment 40*a* and a left compartment 40*b*. The function of the diaphragm 39 could be served also by a piston moving in a cylinder or any movable wall. Chamber 40*a* is connected to the intake manifold by a duct 41 so that intake manifold suction has immediate access to the right side of the diaphragm 39. The left side of the diaphragm 39 is connected to the intake manifold, by means of duct 45, reservoir 44, duct 44*b*, restrictor valve 45, and duct 42 and duct 41. Restrictor valve 43 is interposed between ducts 44*b* and 42, that is, essentially, between the reservoir 44 and the source of manifold suction, thus providing a limited rate of flow. If the valve 43 is completely opened, the diaphragm 39 would remain stationary regardless of any change in the suction in the intake manifold 11, because the suction on both sides would be equal. If the valve 43 is set to restrict the communication between the reservoir 44 and the source of manifold suction, the diaphragm 39 will deflect to the right when the manifold suction increases (as when going from idle at 10 inches hg to 20 mph cruise at 14 + inches hg) because the air standing on its left side reflects the previous suction condition, that is to say it has stored air at higher pressure. The diaphragm 39 will remain deflected until the suction in the reservoir 44 and in the intake manifold 11 has become substantially equalized through transfer past the restriction of the valve 43 within some predetermined interval, e.g. under 14 seconds. When the suction in the intake manifold decreases, (as when accelerating at 10 inches hg or less from a cruise at about 16 inches hg) the diaphragm 39 will deflect to the left, upon analogous reasoning. The function of the sensing device 40 may be described as that of a registering device which in its position indicates whether there has been a change in the suction in the intake manifold and also whether the change has been positive or negative.

The indication provided by the diaphragm 39 is then represented outside the sensing device 40 by means of a rod 46 which is conventionally fastened to the diaphragm 39 and passes through a relatively airtight bushing or seal 47, its far end 46*a* being guided in an upright element 46 of a bracket 49. A hub 59 is fixed on the rod 46 by means of a pin 59*a* and has two arms 57 and 58 extending therefrom. The arms 57 and 58 will therefore represent the condition of the diaphragm 39 which has been discussed above.

The bidirectional indication of the diaphragm 39 is then converted into a bleeding effect upon the duct 32 which is similar for increase and decrease of the suction in the intake manifold 11, by means of bleeding valves 50 and 51 which are disposed in upright elements 53 resp. 48 of the bracket 49 and form the termini for ducts 60, resp. 61 which communicate with the duct 32. Bleeding valves 50 and 51 are similar in construction and only the function of valve 50 shall be explained. The suction standing in duct 32 is normally sealed off by a valve cone 55 which is held in a seat 54 by a spring 56 with a force sufficient to prevent accidental bleeding. When the suction in the intake manifold 11 increases, and the diaphragm 39 pulls the rod 46 and thus the arm 57 to the right, the valve cone 55 will be displaced to the right so that outside air can enter through a port 50*a* and impair or even destroy the suction in the duct 32, due to the limited flow past restrictor 63 with the end result that the diaphragm 34 will move to the left and the vacuum controlled advance of the ignition will be correspondingly affected or eliminated. When the suction in the intake manifold 11 decreases, the bleeding valve 51 will become operative with the same end result.

Certain other equally important features of the arrangement just described have been omitted for the sake of simplifying the description. Thus, stops 46*b* and 46*c* are provided on the rod 46 in order to afford a possibility to limit the magnitude of the response of the sensing device 40. By judicious setting of stops 46*b* and 46*c* it is possible to provide for a substantially unequal response of the sensing device 40 to an increase, resp, decrease in the suction in the intake manifold and thus to modify the bleeding effect accordingly. This principle can be extended to prevent the bleeding in either or in both instances, if that should be desirable for some reason. The arrangement is thus made adjustable within wide limits in its output without the necessity of discriminating between increase, resp, decrease of the manifold suction at the input, esp. the setting of the valve 43 or by providing two power trains.

Springs 65 and 66 are provided which have only incidentally the effect of centering the diaphragm 39. Their essential function lies in two other areas. Since the response of the diaphragm 39 to a change in the manifold suction is, ideally, instantaneous, the setting of the valve 43 merely having the effect of delaying the return to the midposition so that it will take, e.g. 14 seconds or less, the strength of the springs 65 and 66 provides a means to eliminate minor changes in the intake manifold suction from becoming effective upon the diaphragm 39. Such minor changes may be insignificant or, as previously mentioned, other ignition control means may be adapted to cope with them, so that it is desirable to keep the arrangement according to the invention inoperative in such instances. This reasoning may be extended to favor one change over the other, e.g. an increase in suction over a decrease.

The last special feature to be explained is the restriction shown in the duct 32 in the form of a clamp 62 and screw 63. Such special restriction was found necessary in experiments with an existing engine and might be necessary in order to adapt the invention for use with existing engines. The essential function of the restriction is to reduce the response of the diaphragm 34 to a change in the suction at the port 32*a* (which may form the restriction), in order to make it amenable to the bleeding by means of valves 50 and 51. Proper choice of the dimension of port 32*a* in new engines would make a specially installed restriction device unnecessary. I have illustrated the invention in these various forms; however, many other variations may be possible within its scope.

In some cases it may be desirable to connect duct 41 to port 32*a* rather than to manifold 11*a* to reduce the limiting action of diaphragm 39 when idling as by duct 70 shown in drawing.

To those skilled in the art which this invention relates many changes in construction and widely differing embodiments and applications of the invention will suggest themselves without departure from the spirit and scope of the invention. The disclosures and description herein are purely illustrative and are not intended to be in any sense limiting.

I claim as my invention:

1. In an internal combustion engaging provided with a throttle valve, an intake manifold providing a source of suction, the amount of suction being controlled by the throttle position, ignition spark means normally biased to retard timing at closed position of the throttle, and control means operative to overcome said bias to advance the spark timing by increasing suction from the source in response to gradual throttle movement at a rate below a predetermined rate, the improvement comprising: suction change sensitive means responsive to a selected one of either a sudden increase or a sudden decrease in suction at the source in response to sudden movement of the throttle valve greater than the predetermined rate for rendering the control means inoperative to overcome said bias, to permit return of the ignition spark means to retarded timing, said suction change sensitive means including means for maintaining the control means inoperative for an appreciable period of time much longer than the time during which the abrupt change in suction took place whether such change be an increase or a decrease of suction at the source.

2. In an internal combustion engine according to claim 1 wherein the suction change sensitive means includes means adjustable to vary the period of time during which the control means is rendered inoperative.

3. In an internal combustion engine having an intake manifold providing a source of suction and ignition spark means, a spark timing control, said timing control including a suction motor having a suction chamber controlled by the suction source for operating means to advance the timing of the spark in response to an increase in suction of the source against spring opposition to such advance, valve means normally closing the chamber and operative to vent the chamber to atmosphere, suction responsive means operated by suction applied thereto for controlling operation of the valve means, a pair of passageways branching separately from the suction source, each of the passageways being independently connected to the suction responsive means, at least a portion of one of said passageways having an enlarged area to form a reservoir, said one passageway having a restriction therein between the suction source and the reservoir for limiting the rate of fluid flow relative to the other passageway upon either an abrupt increase or a decrease in suction source, to provide a suction differential in said passageways for a predetermined period of time until equalization of suctions in the passageways is effected, said suction responsive means controlling said valve means in response to the suction differential brought about by either one of said abrupt increase or decrease of suction at the source to vent the suction chamber to atmosphere for said predetermined period of time, the initial suction differential in the passageways being produced when the rate of increase or decrease of suction at the source exceeds the rate at which the suction in said passageways are equalized.

4. A spark timing control according to claim 3 wherein means are provided for adjusting the size of the restriction to vary the predetermined period of time.

5. A spark timing control according to claim 3 wherein said suction responsive means comprises a pair of suction housings to each of which one of said passageways is connected, said suction housings being provided with means responsive to the suction differential in the housings for operating the valve means to vent the chamber for the predetermined time period.

6. A spark timing control according to claim 5 in which the pair of housings is provided by a closed shell having a movable partition wall intermediate its ends to form said two housings, the means for operating the valve means being responsive to movement of the wall in either direction under the influence of the differential suction.

7. In an internal combustion engine having an intake manifold providing a source of suction and ignition spark means, a spark timing control, said timing control including a suction motor having a suction chamber controlled by the suction source for operating means to advance the timing of the spark in response to an increase in suction of the source against spring opposition to such advance, valve means normally closing the chamber and operative to vent the chamber to atmosphere, a pair of suction housings each closed at one end by wall means which is movable in response to a difference in the amount of suction in the housings, a pair of passageways branching separately from the suction source at one end and each being connected at its other end to a respective housing, one of the passageways being provided with a restriction for limiting the rate of flow of fluid therein relative to the other passageway upon either an abrupt increase or decrease in suction at the source of suction in order to provide a suction differential in said housings for a predetermined period of time until equalization of suctions in the housings is effected, means rendering the valve means operative to vent the chamber by movement of the wall means due to the difference in suctions in the housings brought about by either one of said abrupt increase or decrease in suction at the source, the initial difference in suctions in the housings being produced when the rate of increase or decrease of suction at the source exceeds the rate at which the suction in the housings are equalized.

8. A spark timing control according to claim 7 including means for selectively varying the size of the restriction for varying said predetermined time period.

9. A spark timing control according to claim 7 wherein the pair of housings is provided by a shell, the movable wall means comprising a movable diaphragm intermediate the ends of the shell to form said pair of housings.

10. In an internal combustion engine having spark ignition means, an intake manifold providing a source of suction and a carburetor connected with the intake manifold having a suction port, a spark timing control, said timing control including a suction motor having a suction chamber connected to the suction port in the carburetor for operating means to advance the timing of the spark in response to an increase in suction of the source against spring opposition to such advance, valve means normally closing the chamber and operative to vent the chamber to atmosphere, such responsive means comprising a housing divided by a flexible diaphragm into a pair of suction chambers, an enclosed hollow chamber, a first passageway connecting the hollow chamber to one suction chamber of the pair, a second passageway connecting the other suction chamber of the pair to the suction manifold, a rod connected to the diaphragm for movement thereby in opposite directions in response to the difference in the suction in the pair of suction chambers, a pair of ports in the suction motor leading to atmosphere, said valve means comprising a pair of valves normally biased to respectively close the ports, and means connected to the rod for operating one of the valves against its bias to open a port when moved in one direction and operating the other of the valves against its bias to open the other port when the rod is moved in the other direction.

* * * * *